United States Patent [19]

Hancock et al.

[11] Patent Number: 4,893,637

[45] Date of Patent: Jan. 16, 1990

[54] APPARATUS AND METHODS FOR MAKING COMPONENTS OF A SMOKING ARTICLE

[75] Inventors: Lloyd H. Hancock, Walnut Cove; Jesse A. Stigall, King; Donald R. Wilkinson, Clemmons, all of N.C.

[73] Assignee: R. J. Reynolds Tobacco Co., Winston-Salem, N.C.

[21] Appl. No.: 97,240

[22] Filed: Sep. 15, 1987

[51] Int. Cl.[4] ..... A24C 5/00; A24C 5/18

[52] U.S. Cl. ..... 131/280; 131/77; 131/78; 131/84.1

[58] Field of Search ..... 131/280, 77, 78, 84.1

[56] References Cited

U.S. PATENT DOCUMENTS

| | | |
|---|---|---|
| 2,164,702 | 7/1939 | Davidson . |
| 3,396,061 | 8/1968 | Browne . |
| 3,774,508 | 11/1973 | Berger et al. . |
| 3,860,011 | 1/1975 | Norman . |
| 4,508,525 | 4/1985 | Berger . |
| 4,585,015 | 4/1986 | Silberstein . |
| 4,727,888 | 3/1988 | Luke . |

FOREIGN PATENT DOCUMENTS

| | | |
|---|---|---|
| 1264962 | 5/1961 | France . |
| 2033749 | 11/1970 | France . |
| 933227 | 8/1963 | United Kingdom . |

*Primary Examiner*—Vincent Millin

*Attorney, Agent, or Firm*—Grover M. Myers; David G. Conlin

[57] ABSTRACT

Apparatus and methods are described for forming a composite member for use in making a smoking article. The apparatus comprises a forming device that comprises (a) an elongate structure having a curved inner surface that tapers from a larger proximal end to a smaller distal end, the proximal end of the structure being adapted to receive a support member and a layer of material which are fed simultaneously into the device, the tapering inward curved inner surface causing the edges of the fibrous layer to bend around the inner support member, and (b) a curved forming surface that causes a first edge of the material to fold over the support member while permitting the second edge to pass by the forming surface, the curved inner surface of the device further tapering to the distal end causing the second edge of the material to fold over the support member proximate to the first edge.

35 Claims, 3 Drawing Sheets

APPARATUS AND METHODS FOR MAKING COMPONENTS OF A SMOKING ARTICLE

BACKGROUND OF THE INVENTION

In the European Patent Publications 0174645(A2) and 0212234(A2), the disclosures of which are hereby incorporated by reference, there are disclosed a number of alternative forms of smoking articles which typically embody (1) an aerosol generating cartridge comprising a fuel element for generating heat for transfer to an aerosol forming material which may contain a tobacco flavoring material, (2) a sleeve or jacket circumscribing the cartridge, the sleeve preferably including an insulating material around the fuel element and a tobacco containing material around the aerosol forming material or, alternatively, an insulating material around the entire aerosol generating cartridge and, optionally, (3) a mouthend piece, which may contain a filter element. Generally, the aerosol generating cartridge comprises a capsule containing an aerosol generating material with a fuel element at one end.

It is a purpose of this invention to provide an apparatus and methods for forming a component for the sleeve or jacket described above that can be used for production of aerosol generating modules for use in smoking articles such as, for example, a cigarette-type smoking article.

SUMMARY OF THE INVENTION

In accord with the present invention, apparatus and methods provided for forming sleeve or jacket components for use in making smoking articles. A jacket component, as used herein, comprises a removable support member, a compressible and resilient layer of material circumferentially disposed about the support member, and an outer wrapper circumferentially disposed about the layer of material to define the outer diameter of the component. This component may be used to circumscribe the fuel element or the aerosol generating cartridge of smoking articles such as those described in the aforesaid European patent applications.

In one embodiment, an apparatus in accord with the invention comprises a forming means or device that receives a length of support member and length of compressible and resilient material, preferably fibrous material in the form of a web, having a width sufficient to wrap around the support member as they pass through the forming device. As used herein, the term "web" means a substantially flat flexible elongate material having a width that is at least five times its thickness such as, for example, a non woven fibrous felt.

The forming device has an arcuate or curved surface structured to fold the web around the support member so that one edge of the web is contiguous to the other edge without any significant overlap. The device has a further tapered arcuate or curved surface encountered by the web after its folded about the support member, which surface compresses the fibrous material, at least slightly, around the support member to form a composite member having a predetermined size. The apparatus further comprises means for wrapping the composite member to maintain the desired size.

Preferably, the support member and web of material are supplied to the apparatus in a continuous manner for high speed production. Thus, preferred apparatus also comprises means for guiding the support member and web into the forming device. The apparatus also preferably comprises means for cutting the wrapped composite member into predetermined lengths that conveniently are multiples of the desired size of the component to be used in a smoking article.

A preferred forming device, in accord with the invention, comprises a funnel or trumpet-like device having an inner arcuate or curved surface that tapers inwardly from its proximal open end for receiving the inner support member and web of fibrous material to its distal end through which the composite member, having the web wrapped around the removable support member, exits. The proximal or entrance end of the device is wide enough for the web to enter without the edges curling. The inner surface of the device is arcuately shaped or curved and tapered inwardly toward the exit end to subsequently cause the edges of the web to curl up and fold around the support member. A portion of the inner surface of the device is shaped to cause one edge of the web to fold over in contact with the support member before the other edge. A second portion of the inner surface of the device is arcuately shaped or curved to cause the second edge of the web to fold over proximate to the first edge. A third portion of the inner surface of the device compresses the web, at least slightly, around the removable support member as the composite member completes its passage through the device and exits the distal end of the device having a predetermined dimension. The forming device can be made in two or more separate sections for ease of construction or, preferably, is formed in one piece. One advantage of the forming device of the invention is that the resulting composite member does not have a typical overlapping double thickness of material where the edges come together but surprisingly has a substantially uniform appearance.

The invention also comprises methods for forming sleeve or jacket components for use in making smoking articles. In one preferred embodiment, a method for forming jacket components having a removable support member comprises providing a substantially continuous web of fibrous material, such as a reel or spool of material; providing a substantially continuous length of a support member, such as tubing from a reel or spool; bringing the web and support member into contact with each other; and folding the web longitudinally around the support member to wrap the support member thereby bringing one longitudinal edge of the web contiguous to the other edge to form a composite member. Preferably, the method also comprises wrapping the composite member with an outer wrapper to provide a predetermined finished size and cutting the wrapped composite member into predetermined lengths for use in making smoking articles.

DESCRIPTION OF THE PREFERRED EMBODIMENTS OF THE INVENTION

Figure 5B:
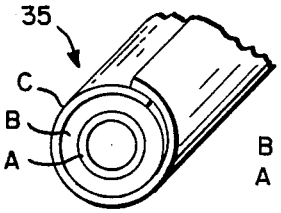
FIG. 5B is a projectional view illustrating the composite member of FIG. 5A provided with a conventional outer wrapper "C"
Figure 5A:
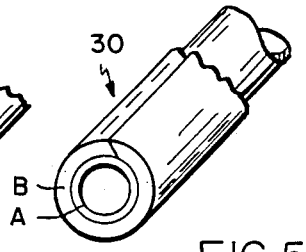
FIG. 5A is an projectional view illustrating a preferred embodiment composite member with the web "B" wrapped around a tubular support member "A" as produced using the device in accordance with the present invention.

In accord with the present invention, an apparatus is provided for the high speed production of a jacket component for a smoking article, which jacket component comprises, FIGS. 5A,5B, a removable tubular support member "A", a layer or layers "B" of compressible resilient material, preferably a fibrous material, having a preferred thickness of about 0.5 to about 2.5 mm, more preferably about 1 to 2 mm, circumferentially disposed about the support member (FIG. 5A) and an outer wrapper "C" circumferentially disposed about the layer of material to provide a predetermined final size (FIG. 5B). The wrapped component is preferably formed continuously from a web of fibrous material and a support member supplied from a large reel. After forming, the continuous length of the wrapped component is cut into pieces of predetermined size, usually a multiple of the size desired for the ultimate jacket component piece that is to be used for one smoking article.

Figure 11:
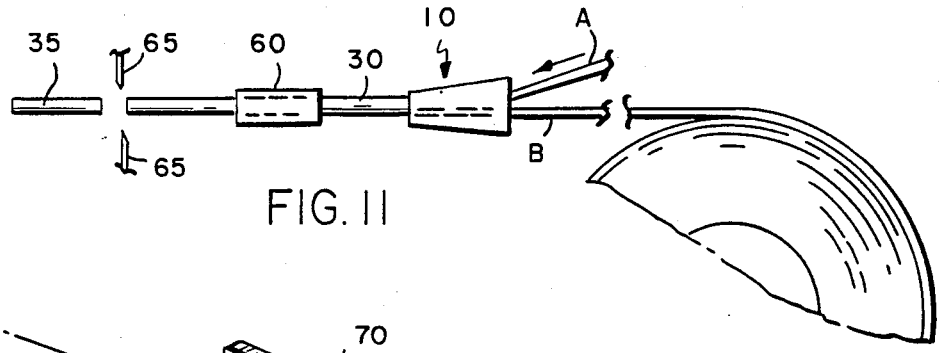
FIG. 11 diagrammatically illustrates a method and apparatus for forming a web around a support member, and wrapping and cutting it into component lengths.

An apparatus for forming the wrapped component 35 (FIG. 5B) is diagrammatically illustrated in FIG. 11. Support "A" is fed with layer or layers "B" of compressible resilient material into forming device 10 to form composite member 30. Composite member 30 is fed into a conventional wrapping device 60 where wrapper "C" is circumscribed around the composite member 30. After exiting the wrapping device 60, the wrapped jacket component 35 is cut by a conventional cutting device 65 into desired lengths for further use in making smoking articles.

Figure 1:
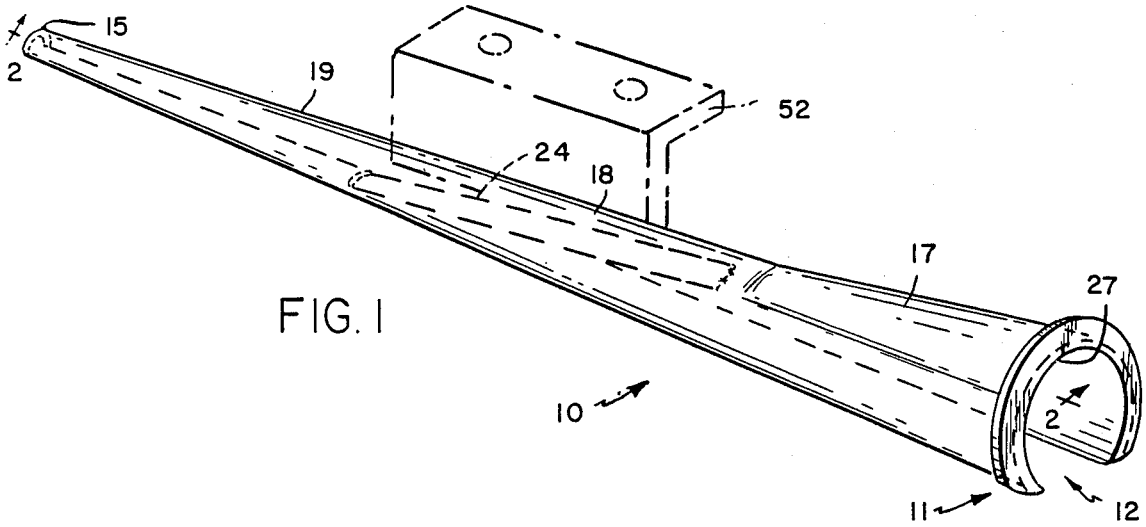
FIG. 1 is an projectional view of a preferred device for continuously forming a web around a support member in accord with the present invention.
Figure 2:
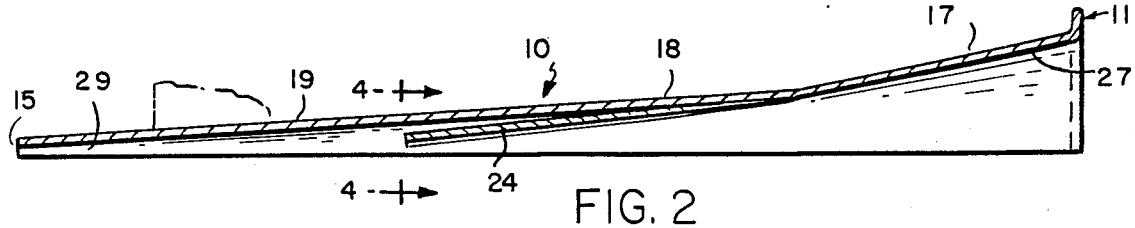
FIG. 2 is a longitudinal section of the device of FIG. 1 taken on the line 2—2 of FIG. 1.
Figure 3:
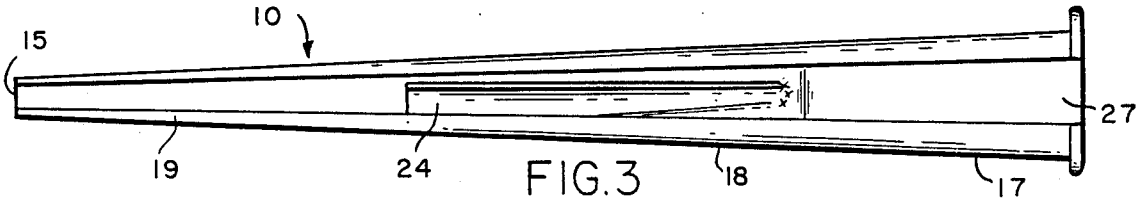
FIG. 3 is a bottom view of the device of FIG. 1.

With reference to the drawings, FIGS. 1 to 3 illustrate a preferred forming device 10 for continuously forming the non-wrapped component or composite member 30 (FIG. 5A). Forming device 10 has a first open, funnel or trumpet-like inlet end 11 that is wide enough to receive the full width of the web of fibrous material "B" (see FIG. 7A) being used. The curved or arcuate inner surface of device 10 tapers inwardly from the entrance end 11 to the exit end 15 through which the composite member 30 (without an outer wrapper) leaves the device. Preferably, the forming device defines a passageway having a generally decreasing cross-sectional area from the entrance end to the exit end.

As illustrated, device 10 comprises three sections 17, 18, 19 formed in one integral piece. However, each of the sections could be formed separately and mechanically held together during use.

Figure 7A:
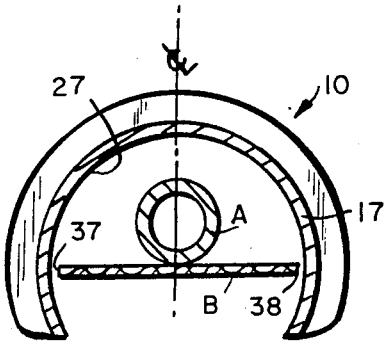
FIGS. 7A, 7B, 7C and 7D are partial cross sections not to scale taken on lines 7A—7A, 7B—7B, 7C—7C and 7D—7D, respectively, of FIG. 6.
Figure 7B:
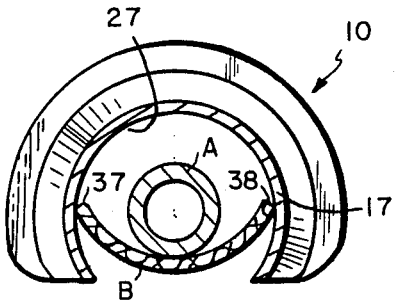

The first section 17 is the entrance section. This section has an inner curved surface 27 that tapers inwardly away from opening 12 in the entrance end 11. The inner curved surface 27 of the entrance section 17 provides an opening 12 of sufficient width to permit the web "B" to enter without distortion (FIG. 7A). As surface 27 tapers inward, the edges of web "B" are curled up and folded partially around the support member "A" by the curved tapered surface (FIG. 7B).

Figure 4:
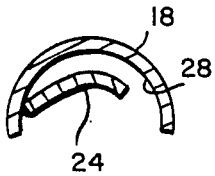
FIG. 4 is a cross-sectional view taken on the line 4—4 of FIG. 2.
Figure 7C:
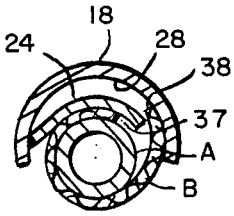

The second section 18 (see FIGS. 2, 7C) is the mid section of the device. This section 18 has an inner curved surface 28 that continues to taper inwardly away from the first section 17. The mid section 18 also has a arcuate or curved separate forming surface 24 (FIGS. 2, 3, 4, 7C) attached at one side to surface 28 and extending partially across the open area enclosed by surface 28 (FIGS. 4, 7C). The forming surface 24 folds one longitudinal edge 37 of web "B" over and in contact with support "A" while permitting the other longitudinal edge 38 of web "B" to pass by surface 24 constrained only by the curvature and taper of surface 28 (FIG. 7C).

Figure 12:
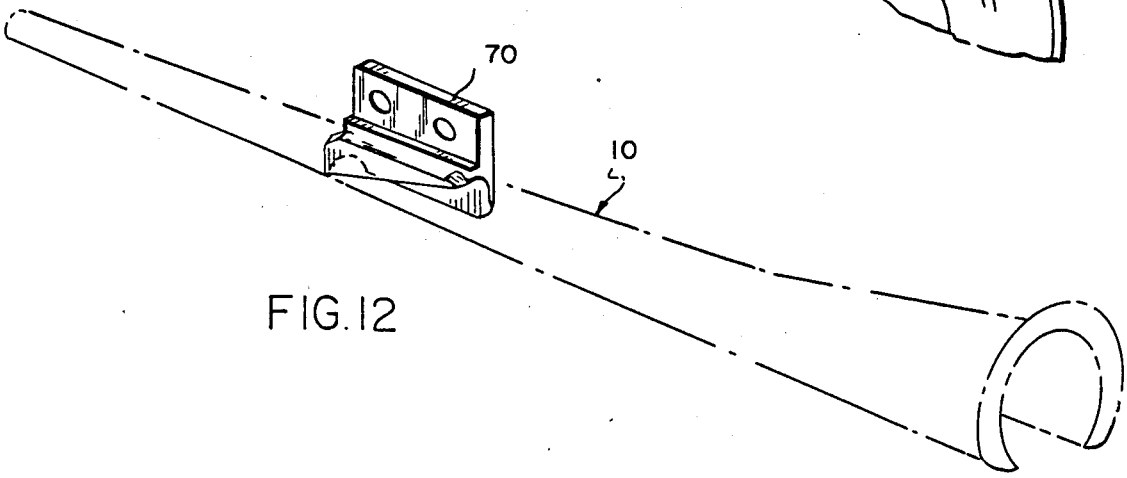
FIG. 12 is a projectional view of a preferred embodiment of a forming surface in the form of an inset for devices in accord with the present invention, which is illustrated as part of a device having the outer shape of the device of FIG. 1.
Figure 14:
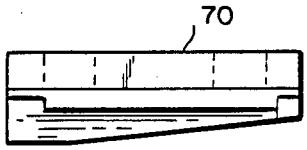
FIG. 14 is a plan view of the insert of FIG. 12.
Figure 15:
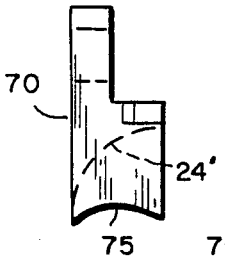
FIG. 15 is a side view from the left of the insert of FIG. 12.
Figure 13:
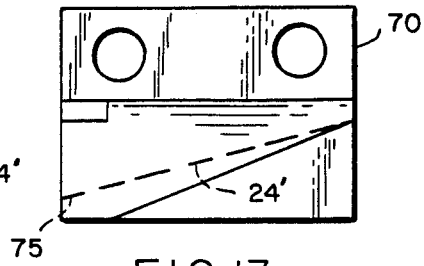
FIG. 13 is a front view of the insert of FIG. 12.
Figure 16:
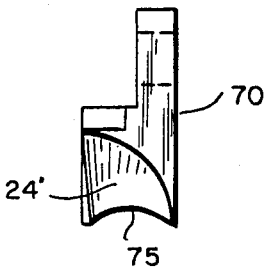
FIG. 16 is a side view from the right of the insert of FIG. 12.
Figure 17:
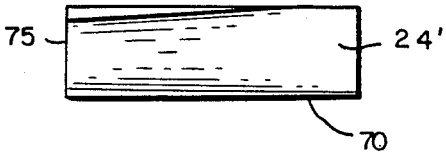
FIG. 17 is a bottom view of the insert of FIG. 12.

Alternatively, the forming surface may be provided by an insert 70 (FIGS. 12–17) having forming surface 24. Insert 70 is set into the mid section of the tapered funnel like device 10 as illustrated in FIG. 12. In the insert illustrated, curved surface 75 has a radius of about 0.156 in. to fold layer "B" in contact with support "A".

Figure 8:
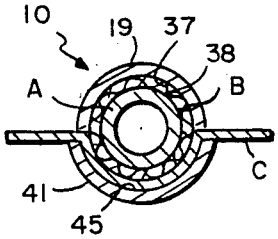
FIG. 8 is a section taken at the end of the forming device showing in cross section a curved support for the outer wrapper "C"
Figure 7D:
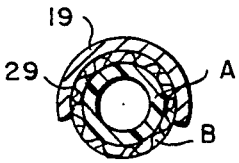

The third section 19 (see FIGS. 2, 7D) has a curved surface 29 that continues the inward taper from the mid section 18 to the exit end 15 where the composite member 30 (FIG. 5A) is formed to a predetermined size, preferably with web "B" compressed about tube "A". In this third section the other longitudinal edge 38 of the web "B" is folded over and in contact with removable support member "A" so that longitudinal edges 37, 38 are brought together to make a resulting layer having substantial uniformity. It is believed that the two edges 37, 38 are brought together in an interengaged or interlaced manner (FIG. 5A) rather than squarely abutting, edge to edge. In any event, web "B" is substantially uniformly wrapped around tube "A", i.e. without an overlapping edge that results in two thicknesses of web at the overlap. The continued taper of surface 29 in conjunction with a channel shaped guide 41 (FIG. 8) then compresses the web "B" around support "A" to a predetermined size at exit end 15. The thickness, density, width of web and the support dimensions are chosen to make the layer uniform when wrapped. Thus, rolling the wrapped composite member 35 between the thumb and forefinger provides a uniform smooth sensation.

Figure 6:
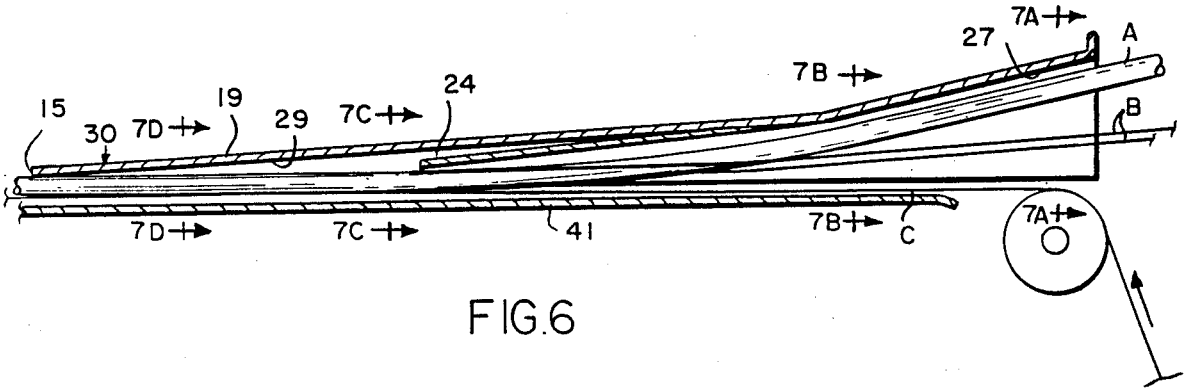
FIG. 6 is a longitudinal section corresponding to FIG. 2 illustrating the support member "A" and web "B" being fed into the device and illustrating the outer wrapping web "C" being fed under the device.

The forming device 10 can be used on, for example, a Hauni KDF-2 filter making machine. The composite member 30, FIG. 5A, is wrapped with conventional cigarette paper wrapping "C", FIG. 5B, in a conventional wrapping device on the KDF-2 immediately upon exiting the forming device 10. The forming device 10 is placed over a channel-shaped member 41 (FIGS. 6, 8), embodying a semi-circular surface 45 (FIG. 8) as in the Hauni KDF-2. The surface 45 cooperates with the forming device 10 to maintain the shape of the composite member 30. The outer wrapper "C", FIG. 8, usually conventional cigarette paper, is fed between the forming device 10 and the channel-shaped guide 41 (see FIGS. 6, 8). As the composite member 30 and wrapper "C" leave the distal end 15, they enter a conventional wrapping device (see 60, FIG. 11) that is part of the apparatus, which device wraps and seals the wrapper "C" about the composite member 30.

After the wrapper "C" is wrapped and sealed around layer "B" to form composite member 30, FIG. 5B, the diameter of the component is fixed. A cutter (see 65, FIG. 11) is arranged transversely of the wrapping device for cutting the wrapped composite member 30 into predetermined lengths for further handling in making smoking articles. Typically, the lengths are a multiple of the size desired to be used for each smoking article. For example, if a 10 mm component length is used for each smoking article, the length of the wrapped composite member may be, for example, 80 mm.

In a typical operation, it may be desired to form a component that has a circumference of about 24.1 mm to make a smoking article such as described in the aforesaid European patent publications. A tube made of low density polyethylene having an outer diameter of 0.178 inches with a 0.020 inch wall thickness may be used as the removable support member. A glass fiber web about 0.032 inch thick having a density of about 160 to 180 $g/m^2$ may be used to wrap the tube. To obtain a material thickness of about 1.5 to 1.6 mm around the tube, two layers of the glass fiber material are used and wrapped simultaneously around the tubular support member "B" by the forming device 10. A web width of the material of about 19 mm is sufficient to wrap around the tubular support member to obtain the final composite member 30 having a circumference of about 24.1 mm. One layer of fibrous web can be used if provided in a suitable thickness and width.

Figure 9:
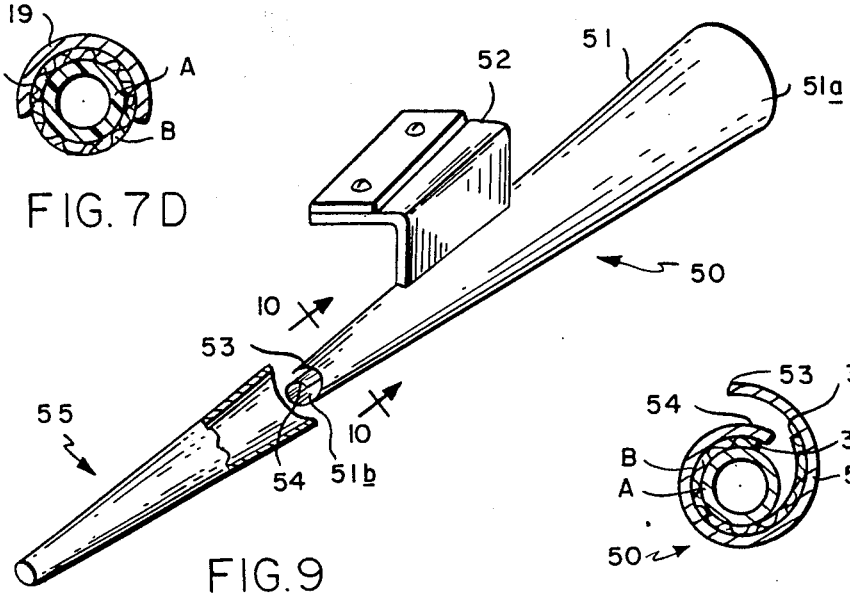
FIG. 9 is a projectional view of an alternative device in accordance with the present invention, which is made in two sections.
Figure 10:
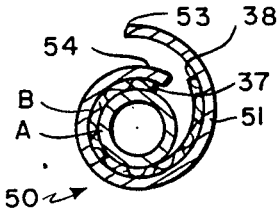
FIG. 10 is a section taken on the line 10—10 of FIG. 9.

An alternative forming device 50 made in accordance with the present invention is shown in FIGS. 9 and 10. The forming device 50 comprises a frusto conical shaped funnel 51 made, for example, from about 18 gauge stainless steel sheet. In one embodiment the large open inlet first end 51*a* through which the web and support member enter is about one inch inside diameter (I.D.). The funnel 51 from tapers down to about 11/32 inch I.D. at the exit end 51*b* and one edge 53 of the stainless sheet is spaced away from the other edge 54 leaving a gap of about 3/32 inch at the exit end. A bracket 52 is used to position the funnel 57 on a modified filter making apparatus.

Forming device 50 comprises curved surfaces that perform the function of the first two sections (17, 18) of device 10 which was discussed above. A second tapered conical section 55, (FIG. 9) which is used in conjunction with forming device 50, performs the function of the third section (19) of device 10. As illustrated in FIG. 10, as tubular support A exits from the funnel 51, one longitudinal edge 37 of web "B" is folded over tube "A" under edge 54 of the device 50 while the second longitudinal edge 38 of web 35 extends along the inner surface of the funnel 51 toward edge 53.

After exiting from the forming device 50, the support tube A and web "B" enter immediately into a tapered section 55 where the second longitudinal edge 38 of web "B" is folded proximate the first and web "B" is compressed, at least slightly, around tube "A" to a predetermined size as the composite member 30 exits the tapered part 55. The composite member can then be wrapped with an outer wrapper with a conventional wrapping device (FIG. 11), as discussed above.

It can be readily appreciated that the other cross-sectional shaped support members can be wrapped with a fibrous web, in accord with the invention, by suitable modification of the cross-section of the forming device used.

In accord with the invention, methods are provided for making jacket components for use in making smoking articles. A preferred method for making jacket components in accord with the present invention comprises providing a substantially continuous length of fibrous material, for instance, in the form of a web or ribbon of predetermined width and thickness wound on a reel or spool and providing a substantially continuous support member such as tubing wound on a reel or spool. The web and support member are brought together longitudinally and the web is longitudinally folded around the support member to have one edge contiguous to the other edge. The fibrous layer is then compressed to provide a predetermined final size wherein the support member is substantially uniformly wrapped with the fibrous material.

Preferably, the sized member is then wrapped with an outer wrapper to maintain the final size. For convenient handling for use in making smoking articles, the wrapped composite member is preferably cut into lengths that are a multiple of the length of a jacket component used for making a smoking article.

This invention has been described in detail including the preferred embodiments thereof. However, it will be appreciated that those skilled in the art, upon consideration of this specification, may make modifications and improvements within the spirit and scope of the invention, which is defined by the appended claims.

What is claimed is:

1. A device for forming a composite member for use in making a smoking article, the composite member comprising a removable support member circumscribed by a layer of compressible and resilient material, the device comprising (a) an elongate structure having a curved inner surface that tapers from a larger proximal end to a smaller distal end, the proximal end of the structure being adapted to receive the support member and the layer of material which are fed simultaneously into the device, the tapering inward curved inner surface causing the longitudinal edges of the layer of material to bend around the inner support member, and (b) a curved forming surface that causes a first longitudinal edge of the material to fold over the support member while permitting the second longitudinal edge to pass by the forming surface, the curved inner surface of the device further tapering to the distal end causing the longitudinal second edge of the material to fold over the support member proximate to the first longitudinal edge.

2. The device of claim 1, wherein the curved inner surface is not a closed surface, the device thereby having a longitudinal opening in the surface extending from end to end.

3. The device of claim 2, further comprising a curved cooperating surface positioned adjacent the longitidunal opening which cooperates with the curved inner surface and curved forming surface to form the composite member.

4. The device of claim 2, wherein the support member is fed into the device between the layer of material and the curved inner surface.

5. The device of claim 1, wherein the curved inner surface tapering to the distal end is structured to cause the layer of material to compress around the removable support member.

6. The device of claims 1 or 4, wherein the curved forming surface is located intermediate the proximal and distal ends of the elongate structure and is disposed between the curved inner surface of the elongate structure and the layer of material.

7. Apparatus for continuously forming an elongate jacket member for use in making smoking articles, the jacket member comprising a removable support member, a layer of fibrous material circumferentially disposed about the support member and a wrapper circumferentially disposed about the layer of material, the apparatus comprising:

means for guiding a support member into the apparatus;

means for guiding a layer of material into the apparatus;

forming means for receiving the support member and the layer of material and forming the layer of material around the support member;

compressing means for compressing the layer of fibrous material around the support member to a predetermined dimension; and wrapping means for disposing a wrapper around the material to maintain the predetermined dimension.

8. The apparatus of claim 7 wherein the forming means comprises means for folding an elongate layer of material longitudinally around the support member so that one longitudinal edge of the material is contiguous to the other longitudinal edge.

9. The apparatus of claim 7 wherein the forming means and compressing means together comprise a tapered device having an entrance end and an exit end through which the support member and layer of fibrous material pass, wherein the entrance end is larger than the exit end, the device comprising a section having a curved forming surface that folds a first longitudinal edge of the fibrous layer around the support member, and a further section having an interior curved surface that tapers inwardly toward the exit end to fold the other longitudinal edge of the layer around the support member contiguous to the first longitudinal edge and that compresses the layer around the support member to a predetermined size.

10. The apparatus of claim 7, wherein the forming means comprises:

a series of sections of curved surfaces that define a passageway that tapers from a larger entrance end to a smaller exit end;

wherein a first section beginning near the entrance end comprises a first curved surface tapering inwardly toward the exit end that causes the longitudinal edges of the fibrous layer to bend around the support member as the fibrous layer and support member pass through the first section;

wherein a second section follows the first section and comprises a second curved surface that continues to taper inwardly toward the exit end;

the second section further having a curved forming surface that extends from the second surface into the passageway to cause a first longitudinal edge of the fibrous layer to fold over the support member while permitting the second longitudinal edge to pass by the forming surface; and wherein a third section follows the second section and comprises a third curved surface that continues to taper inwardly toward the exit end, causing the second longitudinal edge of the fibrous layer to fold over the support member contiguous to the first edge.

11. The apparatus of claim 10, wherein the forming means has a longitudinal opening extending from the entrance end to the exit end.

12. The apparatus of claim 11, further comprising a curved cooperating surface positioned adjacent the longitudinal opening which cooperates with the curved surfaces and the curved forming surface to form the elongate jacket member.

13. The apparatus of claim 11, wherein the support member is fed into the forming means between the fibrous layer and the first curved surface.

14. The apparatus of claims 7, 9 or 10, wherein the means for guiding the support member into the apparatus comprises means for providing and guiding a substantially continuous length of the support member and the means for guiding a layer of material into the apparatus comprise means for providing and guiding a substantially continuous length of the layer of material.

15. Apparatus for forming components for smoking articles, the components comprising a predetermined length of an inner elongate support member having a layer of fibrous material at least 0.5 mm thick circumferentially disposed therearound and having an outer wrapper circumferentially disposed around the fibrous layer, the apparatus comprising:

forming means;

support guide means for guiding the elongate length of support member into the forming means;

web guide means for guiding a web of fibrous material having a predetermined width into the forming means;

the forming means comprising a curved inner surface defining a passage for receiving the support member and web and for folding the web of material around the support member so that one longitudinal edge of the web is contiguous to the other longitudinal edge;

compressing means for compressing the fibrous material around the support member to a predetermined dimension;

wrapping means for holding the fibrous material around the support member at the predetermined dimension and wrapping the fibrous material with an outer wrapper to maintain the predetermined dimension to form a wrapped composite member; and cutting means for cutting the wrapped composite member into predetermined lengths.

16. The apparatus of claim 15 wherein the cutting means cuts the wrapped composite member into lengths that are a multiple of the desired size of the component to be used in a smoking article.

17. The apparatus of claim 15 wherein the forming means and compressing means together comprise a tapered device having an entrance end and an exit end through which the support member and web pass, wherein the entrance end is larger than the exit end, the device comprising a section having a curved forming surface that folds one longitudinal edge of the web around the support member, and a further section having an interior curved surface that tapers inwardly toward the exit end to fold the other longitudinal edge of the web around the support member contiguous to the one edge and that compresses the web around the support member to a predetermined dimension.

18. The apparatus of claim 15, wherein the forming means comprises:

a series of sections of curved surfaces that define a passageway that tapers from a larger entrance end to a smaller exit end;

wherein a first section beginning near the entrance end comprises a first curved surface tapering inwardly toward the exit end that causes the longitudinal edges of the fibrous web to bend around the support member as the web and support member pass through the first section;

wherein a second section follows the first section and comprises a second curved surface that continues to taper inwardly toward the exit end;

the second section further having a curved forming surface that extends from the second surface into the passageway to cause a first longidutinal edge of the fibrous web to fold over the support member while permitting the second longitudinal edge to pass by the forming surface; and wherein a third section follows the second section and comprises a third curved surface that continues to taper inwardly toward the exit end, causing the second longitudinal edge of the fibrous web to fold over the support member contiguous to the first edge.

19. The apparatus of claim 18, wherein the forming means has a longitudinal opening extending from the entrance end to the exit end.

20. The apparatus of claim 19, further comprising a curved cooperating surface positioned adjacent the longitudinal opening which cooperates with the curved inner surfaces and curved forming surface to form the composite member.

21. The apparatus of claim 19, wherein the inner support member is fed into the forming means between the fibrous web and the first curved surface.

22. The apparatus of claim 15 wherein the support guide means comprises means for providing and guiding a substantially continuous length of the support member, and the web-guide means comprises means for providing and guiding a substantially continuous length of the web of fibrous material.

23. A device for forming an elongate composite member comprising an inner support member circumferentially surrounded by a layer of fibrous material, the device comprising:

a series of sections of curved surfaces that define a passageway that tapers from a larger entrance end to a smaller exit end;

wherein a first section beginning near the entrance end comprises a first curved surface tapering inwardly toward the exit end that causes the longitudinal edges of the fibrous layer to bend around the support member as the fibrous layer and support member pass through the first section;

wherein the second section follows the fist section and comprises a second curved surface that continues to taper inwardly toward the exit end;

the second section further having a curved forming surface that extends from the second surface into the passageway to cause a first longitudinal edge of the fibrous layer to fold over the support member while permitting the second longitudinal edge to pass by the forming surface; and wherein a third section follows the second section and comprises a third curved surface that continues to taper inwardly toward the exit end, causing the second longitudinal edge of the fibrous layer to fold over the support member contiguous to the first edge.

24. A device for forming an elongate composite member comprising an inner support member circumferentially surrounded by a layer of fibrous material, the device comprising a longitudinally-tapering funnel open at its opposite ends for receiving at the larger end the support member and fibrous material with the support member and fibrous material disposed substantially symmetrically with respect to the longitudinal axis, the funnel comprising a first curved cross-sectional portion for folding the opposite marginal edges of the fibrous material partway around the support, a second longitudinally-tapering curved cross-sectional portion for folding one of the partially-folded marginal edges of the fibrous material relative to the other to dispose the partially-folded marginal edge about the support member in engagement therewith, and a third longitudinally-tapering curved cross-sectional portion for folding the other partially-folded marginal edge of the fibrous material about the support member relative to the first marginal edge into engagement with both the support member and the first marginal edge of the fibrous material.

25. A device according to claim 24 wherein said first portion defines an axially-elongate first conical surface, said second portion defines an axially-elongate second conical surface eccentric with respect to the first conical surface and said third portion defines a third axially-elongate conical surface concentric with respect to the first conical surface.

26. A device according to claim 24 wherein said second portion comprises an axially-elongate conical segment disposed within the funnel with one longitudinal edge abutting the wall of the funnel and with the other longitudinal edge of the conical segment spaced from the wall of the funnel.

27. A device according to claim 24 wherein the third portion tapers to a cross section such as to compress the fibrous material about the support to a predetermined size.

28. A device according to claim 24 comprising means for supporting an outer wrapper in relation with the fiber-wrapped support member for wrapping about the fiber-wrapped support member.

29. A device according to claim 28 wherein said means defines an elongate support of circular cross section aligned with the longitudinal axis of the funnel for guiding the wrapper into concentric engagement with the fiber-wrapped support member and holding the wrapper in arcuate contact with the fiber-wrapped support member for subsequent wrapping about the fiber-wrapped support member.

30. A device according to claim 29 wherein cutting means is arranged to be moved transversely of the elongate wrapped support member intermediate its ends for cutting the composite structure comprising the fiber-wrapped support member into components of predetermined length.

31. A method for making jacket components for use in making smoking articles, the jacket component comprising a removable support member circumscribed by a layer of compressible and resilient material and having a wrapper circumferentially disposed about the layer of material, the method comprising:

providing a substantially continuous length of support member;

providing a substantially continuous length of fibrous material having a predetermined width and thickness suitable for covering the circumference of the support member;

folding the material longitudinally around the support member so that one longitudinal edge of the material is contiguous to the other longitudinal edge to provide a layer of material around the support member; and wrapping the layer of material to form an elongate wrapped composite member.

32. The method of claim 31, further comprising the step of compressing the layer of material around the support member prior to the wrapping step.

33. The method of claim 32, further comprising cutting the elongate wrapped composite member into lengths of predetermined size.

34. The method of claim 31, wherein the step of folding the material around the support member comprises the steps of first folding one longitudinal edge of the fibrous material over and in contact with the support member and thereafter folding the other longitudinal edge over and in contact with the support member so that the longitudinal edges are contiguous with each other without any significant overlap.

35. The method of claims 31 or 34, wherein the step of providing the substantially continuous length of fibrous material comprises providing two layers of fibrous material and the step of folding the material around the support member comprises simultaneously folding the two layers of fibrous material around the support member.

* * * * *